United States Patent [19]

Schluep

[11] 4,154,281

[45] May 15, 1979

[54] VENETIAN BLIND

[75] Inventor: René Schluep, Unter-Entfelden, Switzerland

[73] Assignee: Storen- und Maschinenfabrik Emil Schenker AG, Schönenwerg, Switzerland

[21] Appl. No.: 833,094

[22] Filed: Sep. 14, 1977

Related U.S. Application Data

[63] Continuation of Ser. No. 706,382, Jul. 19, 1976, abandoned.

[30] Foreign Application Priority Data

Jul. 23, 1975 [CH] Switzerland ..... 9612/75

[51] Int. Cl.[2] ..... E06B 9/38

[52] U.S. Cl. ..... 160/178 R; 160/178 E

[58] Field of Search ..... 160/166–178 R, 160/178 E, 178 F, 236; 49/74; 85/49

[56] References Cited

U.S. PATENT DOCUMENTS

| | | | |
|---|---|---|---|
| 2,008,086 | 7/1935 | Sorenson | 85/49 |
| 2,130,319 | 9/1938 | Hammer | 160/178 R |
| 2,152,117 | 3/1939 | Wade et al. | 160/177 |
| 2,380,655 | 7/1945 | Lang | 85/49 |
| 2,614,343 | 10/1952 | Brandt | 85/49 |
| 3,264,724 | 8/1966 | Griesser | 160/236 |

*Primary Examiner*—Peter M. Caun

*Attorney, Agent, or Firm*—Peter K. Kontler

[57] ABSTRACT

A venetian blind wherein the slats have channel-shaped marginal portions and the flexible strip- or cord-shaped carriers for the slats have equally spaced eyelets for the webs of metallic staples whose legs are driven through the adjacent marginal portions of the slats and are bent over behind the marginal portions to establish a permanent connection between the staples and the slats.

8 Claims, 6 Drawing Figures

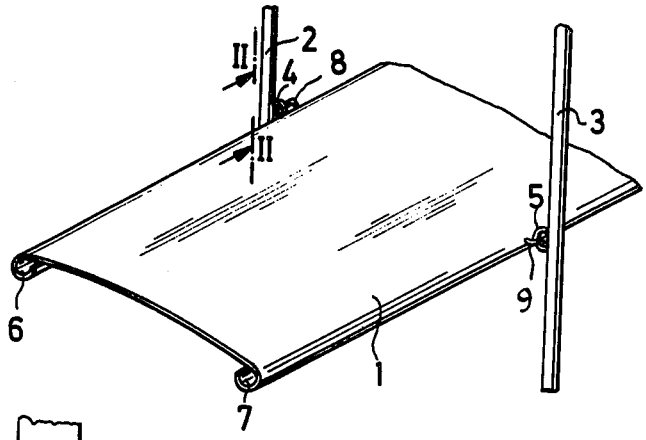
FIG.1
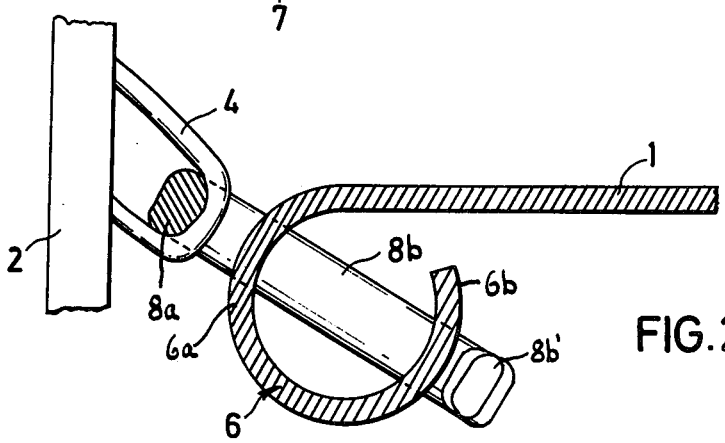
FIG.2
FIG.3
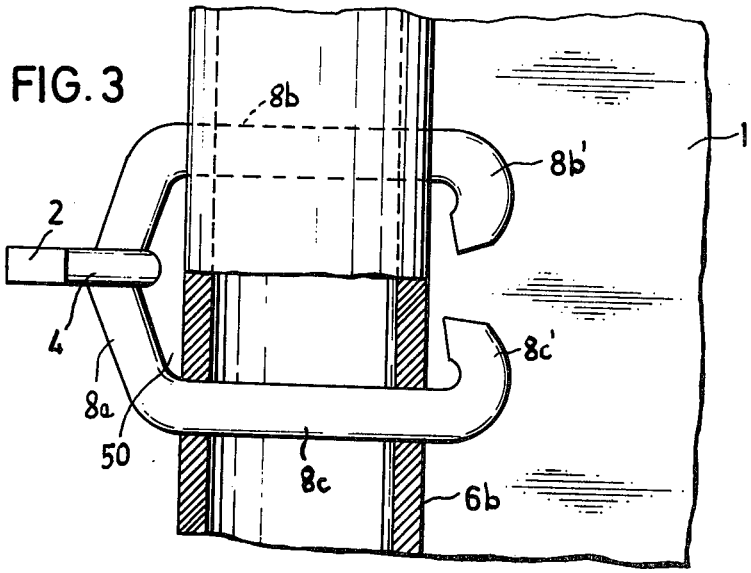

VENETIAN BLIND

This is a continuation, of application Ser. No. 706,382, filed July 19, 1976, now abandoned.

BACKGROUND OF THE INVENTION

The present invention relates to venetian blinds in general and more particularly to improvements in means for mounting slats between flexible cord- or strip-shaped carriers in venetian blinds.

In many presently known venetian blinds, the flexible carriers (which normally consist of woven textile material) are connected to each other by transversely extending rungs or webs which serve as supports for the slats. Such rungs cannot insure that the slats invariably remain parallel to each other. It was also proposed to provide the flexible carriers with equally spaced sockets for the respective marginal portions of the slats. The sockets and the marginal portions establish separable connections between the carriers and the slats. Such proposal failed to gain widespread acceptance because the making and attachment of sockets to the carriers is time-consuming and expensive.

OBJECTS AND SUMMARY OF THE INVENTION

An object of the invention is to provide a novel and improved venetian blind wherein the connections between the flexible carriers and the slats are simple, reliable and inexpensive.

Another object of the invention is to provide novel and improved connecting elements for attachment of slats to flexible carriers of venetian blinds.

One feature of the invention resides in the provision of a venetian blind which comprises at least one pair (normally two or more pairs) of first and second flexible carriers (e.g., strips made of woven textile material), a plurality of parallel slats disposed between the carriers and having first and second (preferably curved, e.g., channel-shaped) marginal portions which are respectively adjacent the first and second carriers, and preferably staple-like connecting elements mounted on the flexible carriers and permanently secured to the respective marginal portions of the slats. In accordance with a presently preferred embodiment, each connecting element has at least one portion which extends through the respective marginal portion.

The carriers preferably comprise equally spaced supports (such as deformable eyelets which are integral with the respective carriers) for the connecting elements. If the connecting elements are metallic staples each of which includes a median portion or web and two legs, the legs are forcibly moved through the marginal portion and the free end of at least one leg of each staple is bent over behind the respective marginal portion to thus establish a practically permanent connection between the staple and the respective slat. If the marginal portions are arcuate, the aforementioned moving step preferably includes forcibly moving each leg through and partially beyond two spaced-apart parts of the respective marginal portion, and the free ends of the legs are bent over behind those parts of the marginal portions which are more distant from the respective carriers.

The novel features which are considered as characteristic of the invention are set forth in particular in the appended claims. The improved venetian blind itself, however, both as to its construction and the mode of assembling the same, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary perspective view of a venetian blind wherein the slats are secured to flexible carriers in accordance with the invention;

FIG. 2 is an enlarged sectional view substantially as seen in the direction of arrows from the line II—II of FIG. 1;

FIG. 3 is a plan view of the structure shown in FIG. 2, with a portion of the slat shown in section;

DESCRIPTION OF THE PREFERRED EMBODIMENTS

Figure 4:
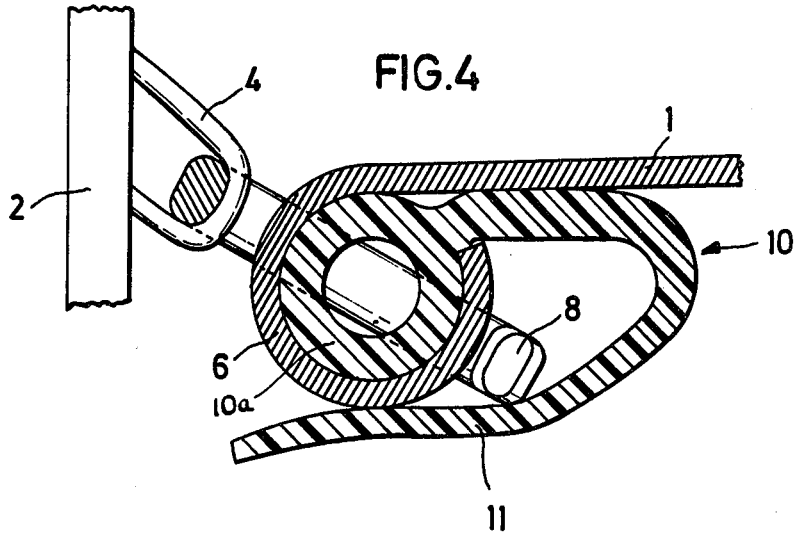
FIG. 4 illustrates a modification of the venetian blind in a view corresponding to that of FIG. 2.

Referring first to FIG. 1, there is shown a portion of a venetian blind which comprises several parallel slats 1 (only one shown) disposed between two upright flexible carriers 2 and 3 made of woven strip- or cord-shaped textile material. It is evident that the blind comprises at least two pairs ofcords 2 and 3; however, the invention can be fully understood without showing more than one pair of carriers. The carriers 2 and 3 are formed with integral supports 4 and 5 which are shown in the form of eyelets (see the eyelet 4 in FIG. 2). These supports are equally spaced from each other.

The slat 1 has two longitudinally extending arcuate (preferably substantially channel-shaped or tubular) marginal portions 6 and 7 which are respectively adjacent the carriers 2 and 3.

In accordance with the invention, the marginal portions 6 and 7 are permanently secured to the cords 2 and 3 by means of connecting elements 8 and 9 in the form of metallic staples each having a median portion or web (see the web 8*a* of FIGS. 2 and 3) which extends through and has at least some freedom of movement relative to the respective support 4 or 5, and two legs (see the legs 8*b*, 8*c* of FIGS. 2 and 3) which extend through the material of the respective marginal portion 6 or 7 and have bent-over free ends (see the free ends 8*b*′, 8*c*′ of FIGS. 2 and 3) which are located behind the respective marginal portion.

The material of the staples 8 and 9 is preferably a metallic wire having a substantially circular cross-sectional outline. Alternatively, and as shown in FIG. 2, each staple may have a polygonal cross-sectional outline with rounded corners in order to avoid excessive wear upon the material of the supports 4 and 5. The legs 8*b*, 8*c* of the staple 8 shown in FIGS. 2 and 3 extend substantially diametrically through the spaced-apart parts or components 6*a*, 6*b* of the respective marginal portion 6 and the free ends 8*b*′, 8*c*′ are bent over behind that component (6*b*) which is more distant from the carrier 2. FIG. 2 shows that the marginal portion 6 closely resembles an elongated tube and that each of the legs 8*b*, 8*c* extends diametrically through such marginal portion. The wire of the staple 8 is strong enough to insure that its legs 8*b*, 8*c* can be driven through the components 6*a*, 6*b* of the marginal portion 6 without it being necessary to make holes in such components prior to mounting of the slat 1 on the carriers 2 and 3. In the embodiment of FIGS. 2 and 3, the free ends 8*b*', 8*c*' of the legs 8*b*, 8*c* are bent toward each other; however, it is equally within the purview of the invention to bend the free ends 8*b*', 8*c*' away from each other (in a manner well known from the art of staplers) or to bend one of the free ends away from the other free end (with reference to FIG. 3, the free end 8*b*' can be bent upwardly or the free end 8*c*' can be bent downwardly). It is further possible to bend only one of the free ends 8*b*', 8*c*'; however, it is presently preferred to bend both free ends in order to enhance the strength of the connection as well as to avoid injury to the operator.

The web 8*a* of the staple 8 of FIGS. 2 and 3 is preferably V-shaped so as to provide a space (shown at 50) for the respective support or eyelet 4. The manner in which the staples 9 are connected with the supports 5 and marginal portions 7 of the slats 1 is the same as described in connection with the staple 8 of FIGS. 2 and 3.

FIG. 4 shows a portion of a slat 1 which is identical with the slat of FIGS. 1 to 3, a portion of the carrier 2 with an eyelet for the web of the staple 8, and a synthetic plastic damping member 10 having a tubular portion 10*a* which is received in the marginal portion 6 and whose outline closely follows the internal surface of the portion 6. The damping member 10 has an extension of flap 11 which is adjacent to the underside of the marginal portion 6 and prevents direct contact with the marginal portion 6 of the slat therebelow (not shown in FIG. 4). The material of the damping member 10 is preferably elastic so that the flap 11 can be bent counterclockwise, as viewed in FIG. 4, to lie against the underside of the central portion of the slat 1 during forcible movement of the legs of staple 8 through the two spaced-apart components of the marginal portion 6. The flap 11 thereupon automatically reassumes the position shown in FIG. 4. This illustration shows that the material of the slat 1 is a metallic substance; however, it is equally possible to use slats which are made of wood or of a synthetic plastic substance. All that counts is to insure that the legs of the staples can penetrate through the marginal portions of the slats, preferably without resorting to the step of providing the marginal portions 6 and 7 with holes prior to attachment of such marginal portions to the respective flexible carriers.

Figure 5:
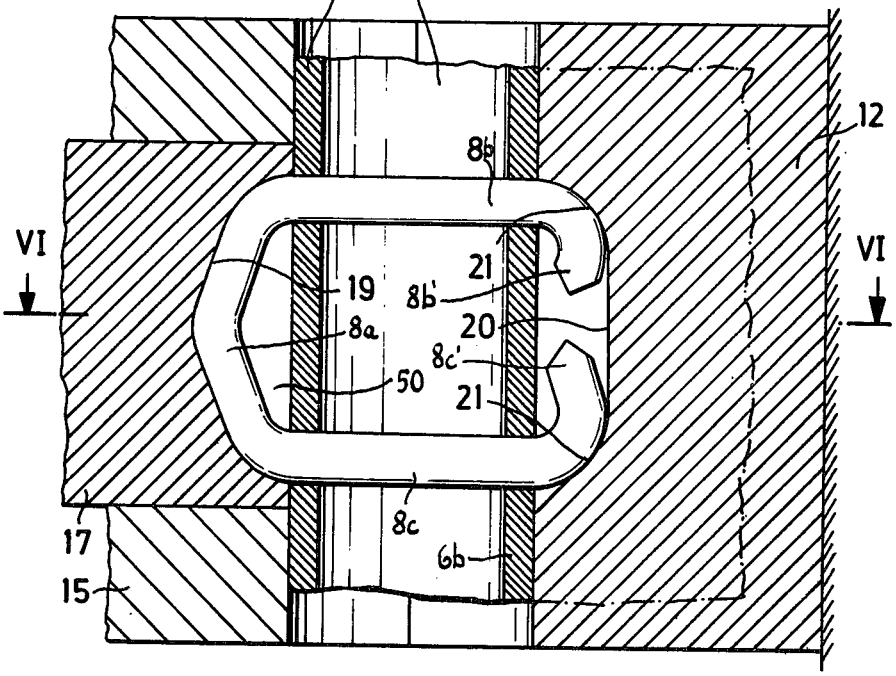
FIG. 5 is a horizontal sectional view of an apparatus for assembling slats with connecting elements therefor, the section being taken along the line V—V of FIG. 6 as seen in the direction of arrows.
Figure 6:
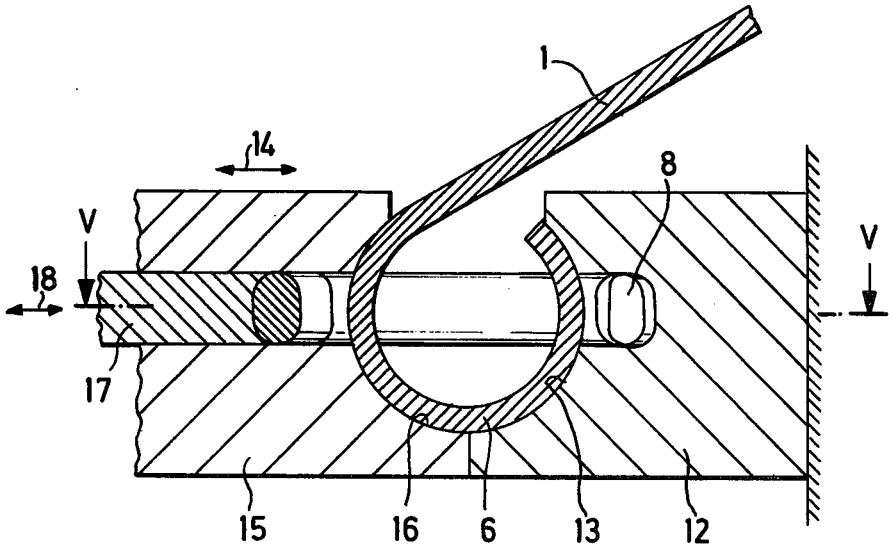
FIG. 6 is a sectional view as seen in the direction of arrows from the line VI—VI of FIG. 5.

FIGS. 5 and 6 show a simple apparatus which can be used for assembling the slat 1 with the carriers 2 and 3. The marginal portion 6 of the slat 1 shown in FIGS. 5 and 6 is inserted into a complementary socket or recess 13 of a stationary deforming member 12. A second deforming member 15 is movable with respect to the member 12 in directions indicated by a double-headed arrow 14 and has a second socket 16 which is adjacent to the socket 13 when the member 15 assumes the position shown in FIGS. 5 and 6. The sockets 13 and 16 then form a cradle which can receive the entire marginal portion 6 of a slat 1. A ram 17 is installed in the deforming member 15 and is reciprocable therein in the directions indicated by a double-headed arrow 18. The front end face 19 of the ram 17 is configurated with a view to convert the median portion 8*a* of a staple 8 into a substantially V-shaped body, i.e., to provide the aforementioned space 50 for the respective eyelet or support 4. The deforming member 12 has a cutout 20 which is located opposite the front end face of the ram 17 and is bounded by a surface having concave portions 21.

The operation of the apparatus of FIGS. 5 and 6 is as follows:

The deforming member 15 is moved away from the deforming member 12 so that the right-hand half of a marginal portion 6 can be inserted into the socket 13. The ram 17 is retracted so that a fresh staple 8 can be inserted into the deforming member 15 in front of the ram. The member 15 is thereupon moved toward the member 12 so that its recess 16 receives the left-hand half of the marginal portion 6. In the next step, the ram 17 is moved in a direction to the right toward the extended position of FIG. 5 or 6 whereby its front end face 19 deforms the median portion 8*a* and the legs 8*b*, 8*c* are forcibly moved through the components 6*a* and 6*b* of the marginal portion 6. The free ends 8*b*', 8*c*' of the legs 8*b*, 8*c* penetrate through and beyond the components 6*a*, 6*b* and are bent by the surfaces 21 in the deforming member 12 so that they overlie the rear or inner side of the component 6*b*. The member 15 is then moved away from the member 12 and the ram 17 is retracted. The marginal portion 6 is removed from the socket 13, together with the deformed staple 8, and the apparatus is ready to receive the next marginal portion 6 and a fresh staple. The same apparatus can be used to connect staples 9 to the marginal portions 7 of successive slats. If desired, each staple 9 can be connected to the marginal portion 7 of a slat 1 simultaneously with attachment of a staple 8 to the marginal portion 6 of the same slat.

The manner in which the median portion 8*a* of the staple shown in FIGS. 5 and 6 is passed through the respective eyelet 4 and in which the ram 17 is recessed in order to accommodate the adjacent portion of the carrier 2 is not shown in the drawing. As a rule, the material of the carrier 2 or 3 can readily withstand pressures which are needed in order to forcibly move the legs of staples through the marginal portions of slats and to thereupon bend the free ends of the legs behind such marginal portions.

An important advantage of the improved venetian blind is that the slats need not be formed with prefabricated holes or bores for the legs of the staples, as well as that the staples are simple and inexpensive so that they contribute only negligibly to the cost of the blind. Moreover, the staples establish a reliable connection between the eyelets 4, 5 and the respective marginal portions of the slats so that the slats remain parallel to each other.

The manner in which the slats can be pivoted to increase or reduce the amount of light which passes through the blind and/or the manner in which the neighboring slats can be moved nearer to or away from each other is the same as in conventional venetian blinds.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a venetian blind, the combination of spaced-apart first and second flexible carriers; a plurality of parallel slats disposed between said carriers and having first and second substantially tubular marginal portions respectively adjacent said first and second carriers, each of said marginal portions having two components located opposite each other; and connecting elements mounted on said carriers and permanently secured to the respective marginal portions of said slats, each of said connecting elements having at least one portion which extends, without any clearance, through both components and substantially diametrically of the respective marginal portion.

2. The combination of claim 1, wherein said flexible carriers comprise equally spaced supports for said connecting elements and said elements are staples each of which includes a plurality of legs extending, without any clearance, through both components and substantially diametrically of the respective marginal portion and having free ends, the free end of at least one leg of each staple being bent over behind the respective marginal portion.

3. The combination of claim 2, wherein said supports are eyelets which are integral with the respective carriers.

4. The combination of claim 1, further comprising damping members installed in said marginal portions.

5. The combination of claim 4, wherein said damping members have an outline which conforms to the internal surfaces of the respective marginal portions.

6. The combination of claim 2, wherein each of said staples has a substantially circular cross-sectional outline.

7. The combination of claim 2, wherein each of said staples has a polygonal cross-sectional outline with rounded corners.

8. The combination of claim 1, wherein said slats consist, at least in part, of metallic sheet material.

* * * * *